US006096118A

United States Patent [19]

Altman et al.

[11] Patent Number: 6,096,118

[45] Date of Patent: Aug. 1, 2000

[54] ELECTROSTATIC SEPARATOR FOR SEPARATING SOLID PARTICLES FROM A GAS STREAM

[75] Inventors: Ralph F. Altman, Chatanooga, Tenn.; Bruce H. Easom, Groton; Leo O. Smolensky, Concord, both of Mass.

[73] Assignee: Electric Power Research Institute, Incorporated, Palo Alto, Calif.

[21] Appl. No.: 09/360,978

[22] Filed: Jul. 26, 1999

Related U.S. Application Data

[62] Division of application No. 08/833,886, Apr. 10, 1997, Pat. No. 5,961,693.

[51] Int. Cl.[7] ..... B03C 3/06; B03C 3/80

[52] U.S. Cl. ..... 96/50; 55/DIG. 38; 96/60

[58] Field of Search ..... 96/50, 66, 77–79, 96/60; 95/74, 78, 79; 55/DIG. 38

[56] References Cited

U.S. PATENT DOCUMENTS

| | | | |
|---|---|---|---|
| 1,931,436 | 10/1933 | Deutsch | 96/64 |
| 2,142,128 | 1/1939 | Hoss et al. | 95/79 |
| 2,142,129 | 1/1939 | Hoss et al. | 96/66 |
| 2,701,622 | 2/1955 | Hodson | 96/50 |
| 2,729,302 | 1/1956 | True | 96/67 |
| 2,852,093 | 9/1958 | Streuber | 96/86 |
| 3,129,157 | 4/1964 | Loeckenhoff | 204/553 |
| 3,143,403 | 8/1964 | Swensen | 96/86 |
| 3,233,391 | 2/1966 | Olsen | 96/50 X |
| 3,509,695 | 5/1970 | Egan et al. | 96/50 X |
| 3,569,751 | 3/1971 | Ruhnke | 310/10 |
| 3,616,606 | 11/1971 | Vincent | 96/66 |
| 3,668,836 | 6/1972 | Richardson et al. | 96/66 |
| 3,678,653 | 7/1972 | Buschman | 96/60 |
| 3,910,779 | 10/1975 | Penney | 96/66 |
| 3,915,676 | 10/1975 | Reed et al. | 55/304 X |
| 3,966,435 | 6/1976 | Penney | 96/66 |
| 3,999,964 | 12/1976 | Carr | 55/521 X |
| 4,166,729 | 9/1979 | Thompson et al. | 96/79 |
| 4,205,969 | 6/1980 | Matsumoto | 96/66 |
| 4,313,739 | 2/1982 | Douglas-Hamilton | 96/66 X |
| 4,354,858 | 10/1982 | Kumar et al. | 95/78 |
| 4,354,888 | 10/1982 | Bompard et al. | 156/175 |
| 4,357,151 | 11/1982 | Helfritch et al. | 55/508 X |
| 4,405,342 | 9/1983 | Bergman | 95/69 |
| 4,750,921 | 6/1988 | Sugita et al. | 96/67 |
| 4,941,962 | 7/1990 | Inoue | 204/639 |
| 5,302,190 | 4/1994 | Williams | 95/57 |
| 5,403,383 | 4/1995 | Jaisinghani | 95/69 |
| 5,474,599 | 12/1995 | Cheney et al. | 96/55 |
| 5,665,142 | 9/1997 | Wright | 96/74 X |
| 5,961,693 | 10/1999 | Altman et al. | 95/78 |

FOREIGN PATENT DOCUMENTS

| | | | |
|---|---|---|---|
| 168565 | 6/1951 | Australia | 96/50 |
| 673302 | 7/1979 | Russian Federation | 96/66 |
| 799625 | 8/1958 | United Kingdom | 96/66 |

*Primary Examiner*—Richard L. Chiesa
*Attorney, Agent, or Firm*—Leonard Bloom

[57] ABSTRACT

A two-stage electrostatic separator for separating particles from a particle laden gas stream includes a pre-charging section and spaced-apart gas-permeable grounded and discharge electrodes charged at opposite polarities and defining a separating section between them, the grounded electrode being positioned upstream from the discharge electrode. The particles in the particle laden gas stream are pre-charged to a certain charge in the pre-charging section and penetrate through the grounded electrode into the separating section, where the particles are separated from the particle laden gas stream. As a result, a clean gas stream exits from the separating section through the discharge electrode, and the particles separated from the particle laden gas stream are partially collected on the grounded electrode, and partially are removed with a bleed flow which is recirculated. The electrodes may be of linear or cylindrical shape, and linear electrodes may be arranged in a "zig-zag" order.

13 Claims, 8 Drawing Sheets

ELECTROSTATIC SEPARATOR FOR SEPARATING SOLID PARTICLES FROM A GAS STREAM

RELATED APPLICATIONS

This application is a divisional application of our Ser. No. 08/833,886 filed Apr. 10, 1997 and now U.S. Pat. No. 5,961,693.

FIELD OF THE INVENTION

The present invention relates to the separation of particles from gas streams and, more particularly, to a compact high-efficiency system which incorporates a separator employing electrostatic forces to separate particles from particle laden gases.

BACKGROUND OF THE INVENTION

Various electrostatic separators have been used for separating solid particles from gas streams. Often, the electrostatic separators are two-staged systems which include a pre-charger where the particles in the gas stream are charged, and spaced electrodes between which an electric field is created such that the charged particles are separated from the gas stream and are precipitated on a collecting electrode.

In plate-type separators these electrodes are made as plates that provide a well-developed collecting surface.

Disadvantageously, the conventional plate-type electrostatic separators have certain drawbacks, which include collection efficiency reduction due to high or low dust resistivity, reentrainment due to mixing of gas and broken dust layer, leakage of untreated dust from sides of the electrodes, and sweepage due to leakage from below the electrodes over the hoppers. When the dust resistivity is great enough, the potential gradient through the dust layer formed on the collecting electrodes may locally exceed the layer's breakdown potential. This causes a phenomenon known as "back-corona", "back-discharge", "back-ionization", or "reverse-ionization" and reentrainment of collected particles in the clean stream. On the other hand, when the resistivity of the dust is low, there is little force to hold it on the collecting electrodes. Not only is the dust held insecurely, but it packs together loosely so that its cohesivity is also low. Therefore, the dust can be removed from the electrodes by high gas velocities.

Rapping reentrainment in severe cases can account for more than 90% of the outlet dust burden. When rapped, poorly cohesive dust tends to break into a cloud of small clumps instead of falling neatly into the hopper as a coherent sheet. As a consequence, much of the dust returns to the gas flow and, unless it is intercepted, will escape from the precipitator outlet, thereby lowering collection efficiency.

Certain attempts have been undertaken in the art for improving the collection efficiency of the existing plate-type electrostatic separators. Specifically, the prior art discloses gas-permeable discharge and grounded electrodes forming a section wherein pre-charged particulates are separated from the gas stream and collected on grounded electrode surfaces. Different configurations of these electrodes, including planar, circular, v-shaped, etc., are suggested, as well as means for pre-charging particulates. These systems are described in numerous patents and publications.

For instance, U.S. Pat. Nos. 2,142,128 and 2,142,129 disclose an electrical precipitator in which a gas stream passes first through the ionizing field and then moves towards two perforated electrodes crossing the gas stream.

The first of these perforated electrodes is charged at the same polarity as the particles, such that the particles are repelled from this electrode towards the grounded collecting electrode whereon they are precipitated. A satisfactory efficiency is intended due to the gas stream and the precipitating field exerting their respective forces in the same direction on the suspended particles, thereby reinforcing each other in effecting precipitation of the particles.

The collecting effectiveness of electrostatic precipitators employing gas-permeable grounded collector plates situated downstream of the discharge electrodes can also be increased when a filter media is disposed between the electrodes. In this case, an electrical field exists through the filter media and the particles leaded by this electrical field are retained in the filter media. These electrostatic filters are disclosed in U.S. Pat. Nos. 2,729,302; 3,910,779; 3,915,676; 3,966,435; 3,999,964; 4,205,969; 4,354,888; 4,357,151; 4,405,342; 5,403,383; and 5,474,599. The filters are periodically removed and cleaned or discarded.

When gas-permeable grounded collector plates are situated downstream of the discharge electrodes, and electrostatic forces act in the same direction as drag forces, the dust layer can be formed and held securely on the collecting electrode surfaces, especially if a filter media is disposed between the electrodes. In these cases, the collectors are able to provide high collection efficiencies, but clean stream should penetrate through pores of the dust layer, and collectors will have relatively high pressure drops in comparison with conventional plate-type electrostatic precipitators at comparable conditions. If the dust layer on the electrode surfaces has not been formed yet (i.e., after cleaning the collector surfaces), the collector efficiencies are relatively low (similar phenomena are observed for bag filters after their cleaning cycles).

The prior art discloses also electrostatic precipitators with the gas-permeable grounded electrodes situated upstream of the discharge electrodes. For instance, U.S. Pat. No. 3,616,606 discloses a multistage electrostatic precipitator which includes a first, or conventional, pre-charging section and a second section comprising a plurality of parallel perforated plates traversing the gas flow. The first grid of the second section is charged to a positive potential, and the remaining grids are arranged such that each two adjacent plates are oppositely charged. Once the negative particles which are not detained in the first section enter the second section, they are attracted by the first grid and are collected thereon. Those which have not been affected by the first grid, pass through the second, negatively charged, grid and are collected on the third grid, positively charged, etc. Some of the negatively charged particles passing through the second grid will be repelled therefrom and return to the first grid, where they will be collected and removed. Similarly, the positively charged particles will be collected on the negatively charged grids.

U.S. Pat. No. 3,668,836 discloses an electrostatic precipitator with respective grounded collector plates upstream of the adjacent electrically charged wires. The first perforated plate is transversely disposed in the duct, so that the gas stream initially passes through the openings in the first plate. A high voltage potential is maintained between the ionizing wires and the grounded plates, and the entrained discrete particles are deposited from the gas stream onto the plates, due to an electrostatic precipitation mechanism in which the particles receive a charge from the wires and are discharged by and onto the plates.

Like other types of electrostatic precipitators with gas-permeable electrodes, the systems disclosed in U.S. Pat.

Nos. 3,616,606 and 3,668,836 require collecting electrodes which should be able to hold securely the dust on the collecting electrode surface. Inability to hold this dust results in reentrainment of particles in the clean stream. However, when grounded collector plates are situated upstream of the discharge electrodes, and electrostatic and drag forces act in the opposite directions (i.e., U.S. Pat. Nos. 3,616,606; 3,668,836), drag forces promote removing particles from the collecting electrode surfaces (especially particles covering the plate apertures) and reentrainment of these particles in the clean stream.

As can be seen, a necessary prerequisite required to achieve high collection efficiencies for all prior art systems, including those employing gas-permeable discharge and grounded collecting electrodes, is the collecting electrode ability to hold securely the dust on the collecting electrode surface. In some cases, i.e., when a filter media is disposed between electrodes, the dust layer can be formed and held securely. However, these systems have relatively high pressure drops. When the dust layer cannot be formed or held securely on the collecting electrode surfaces, the electrostatic precipitators will have relatively low collection efficiencies.

It will be greatly advantageous to design an electrostatic separator which would be able to employ gas-permeable discharge and grounded electrodes but which collection efficiency would not depend on the system ability to form and hold the dust layer on the grounded electrode surfaces. This separator would not have the shortcomings and deficiencies of the existing state-of-the-art electrostatic precipitators.

BRIEF SUMMARY OF THE INVENTION

It is, therefore, an object of the present invention to provide a compact electrostatic separator having a very high separation efficiency, and a low power consumption.

It is another object of the present invention to provide an electrostatic separator capable of effective operation at high and low solids loadings and free of media cleaning problems.

According to the teachings of the present invention, a two-stage electrostatic separator includes a pre-charging section and a separating section in fluid communication with the pre-charging section and positioned downstream therefrom. Preferably, at least a pair of spaced-apart gas-permeable electrodes are charged at opposite polarities, constituting a separating section therebetween. A first one of the pair of electrodes is positioned upstream from a second one of the pair of electrodes and is grounded. The particles in the particle laden gas stream are pre-charged to a certain charge in the pre-charging section and penetrate through the first electrode into the separating section, wherein the particles are separated from the particle laden gas stream and are partially collected on the grounded electrode. The particles, which are not collected, are removed from the separating section with a bleed flow arranged in a plane substantially perpendicular to a plane of the gas stream. A clean gas stream exits from the separating section through the second electrode.

Optionally, the bleed flow can be directed to a particle collector and then recirculated back to the inlet of the separator. In one embodiment, a particle collector can be situated downstream from the bleed flow outlet, such that the bleed flow passes through the collector prior to being supplied to the incoming particle laden gas stream. In another embodiment, a particle collector is situated upstream from the separator, such that both the incoming particle laden gas stream and the bleed flow pass through this particle collector. In the first embodiment, the particle collector is quite compact because it treats only a small fraction of the process flow. In the latter embodiment, the separator performs as a polishing device for the underperforming particle collector.

To minimize the drag forces acting on particulates and the flow turbulence, the gas velocities in the separating section should be quite low. That can be achieved by using many parallel separating sections. Grounded electrodes in this separator can consist, for example, of plates with different types of holes or louvers arranged along or across the main flow direction.

Preferably, this separator includes a plurality of pairs of spaced apart gas-permeable electrodes arranged in a "zig-zag" (or "accordion") order. The grounded (or first) electrodes of adjacent pairs of electrodes constitute a conduit receiving the particle laden gas stream. The discharge (or second) electrodes of adjacent pairs of electrodes constitute a section expelling the clean gas stream. The particles are removed from the separation section of each of the plurality of the pairs of electrodes with a bleed flow arranged in a plane substantially perpendicular to the incoming particle laden gas stream and the outgoing clean gas stream.

Preferably, a row of front insulator sections and a row of rear insulator sections are arranged in front and at the rear of the conduits and the expelling sections, respectively. Then the incoming gas stream enters the conduits between the front insulator sections, and the clean gas is expelled through the space between the rear insulator sections.

Preferably, the pre-charging section has a plurality of ionizing electrodes each arranged upstream from and between the adjacent of said plurality of front insulator sections. A plurality of water cooled tubes is provided, such that each is adjacent to a respective one of the plurality of front insulator sections.

The separator has an inlet for incoming particle laden gas and two outlets, one outlet for the clean gas stream and another outlet for outgoing bleed flow. A housing accommodating a separating section has an entering section, a middle section and an exiting section. Preferably, the entering and the exiting sections of the housing extend from the middle section in opposite directions gradually narrowing towards the inlet and the first outlet, respectively.

The particle laden gas stream flows into the inlet, and flows into the entering section of the housing and diverges therein, thereby slowing down the motion thereof After this, the particle laden gas stream slowly flows into the middle section of the housing, wherein the particles are separated from the gas; and the clean gas stream flows from the middle section towards the first outlet through the exiting section of the housing, wherein it converges towards the first outlet of the separator.

The separating sections can have linear or circular design configurations. In the latter case, one of the electrodes, discharge or grounded, can be situated in the core of the plenum fenced by the other electrode.

These and other objects of the present invention will become apparent from a reading of the following specification taken in conjunction with the enclosed drawings.

DESCRIPTION

Figure 1:
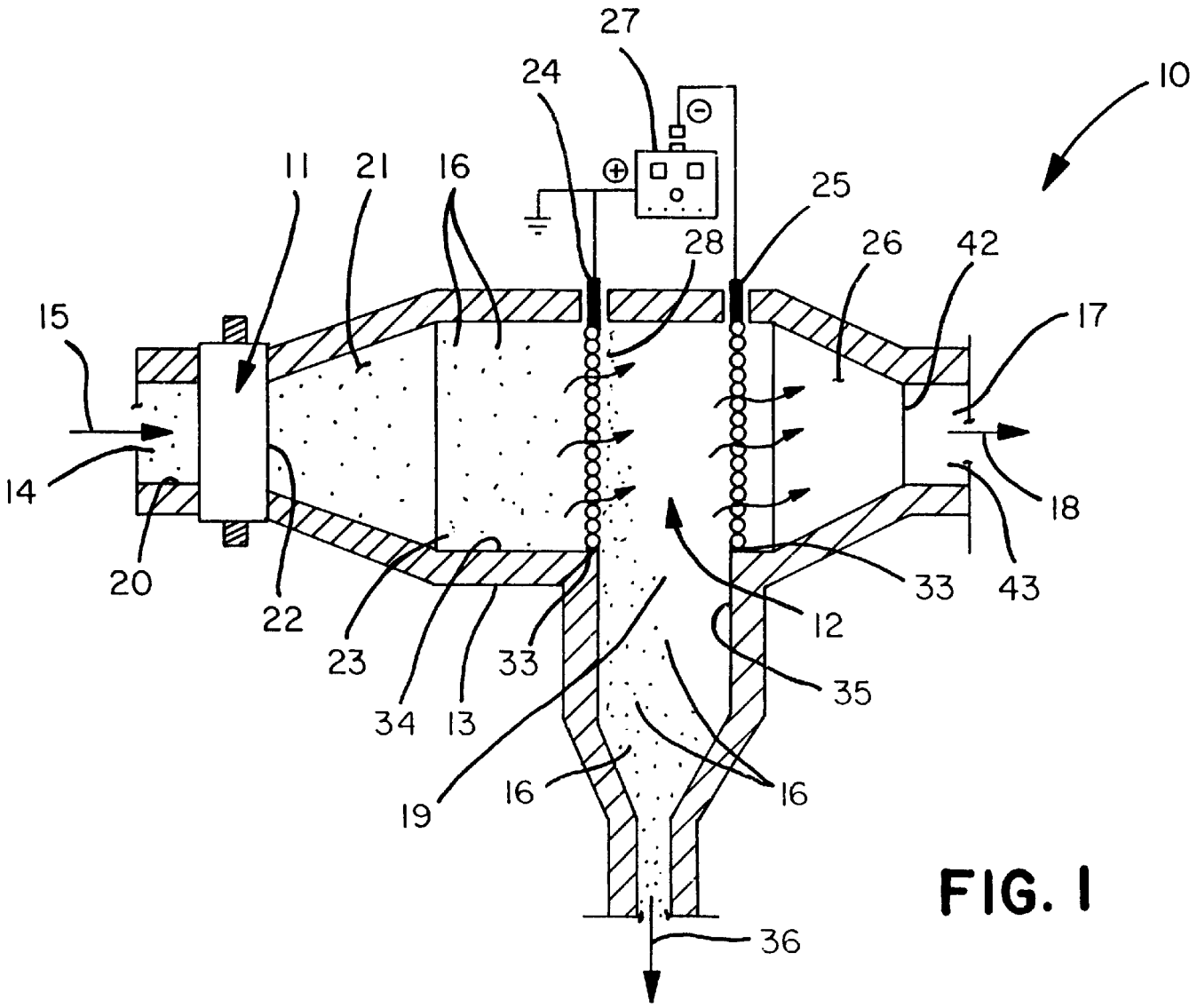
FIG. 1 is a longitudinal cross-section of the electrostatic separator of the present invention according to one embodiment thereof.

Referring to FIGS. 1–5, an electrostatic separator 10 of the present invention (further referred to as "ES") includes a pre-charging section 11 and a separating section 12 in fluid communication with the pre-charging section 11. Both the pre-charging and separating sections 11 and 12 are accommodated within a housing 13 which has an inlet 14 for an incoming gas stream 15 laden with a plurality of particles 16, an outlet 17 for outgoing clean gas stream 18 and an outlet 19 intended for the purposes further explained herein.

As best shown in FIGS. 1–4, the particle laden gas stream 15 enters the ES 10 through the inlet 14, flows along an inlet channel 20 and enters into the pre-charging section 11 where an electrostatic charge of a certain polarity is imparted on the particles 16. The gas stream 15 with the pre-charged particles 16 then flows into a cone-like entering section 21 of the housing 13 with a narrower end 22 connected to the inlet channel 20 and diverges in the entering section 21. As a result, the gas stream 15 flowing into a middle section 23 of the housing 13 has a relatively low velocity and a reduced flow turbulence that is essential for minimizing the drag forces acting on the particles 16.

Figure 2:
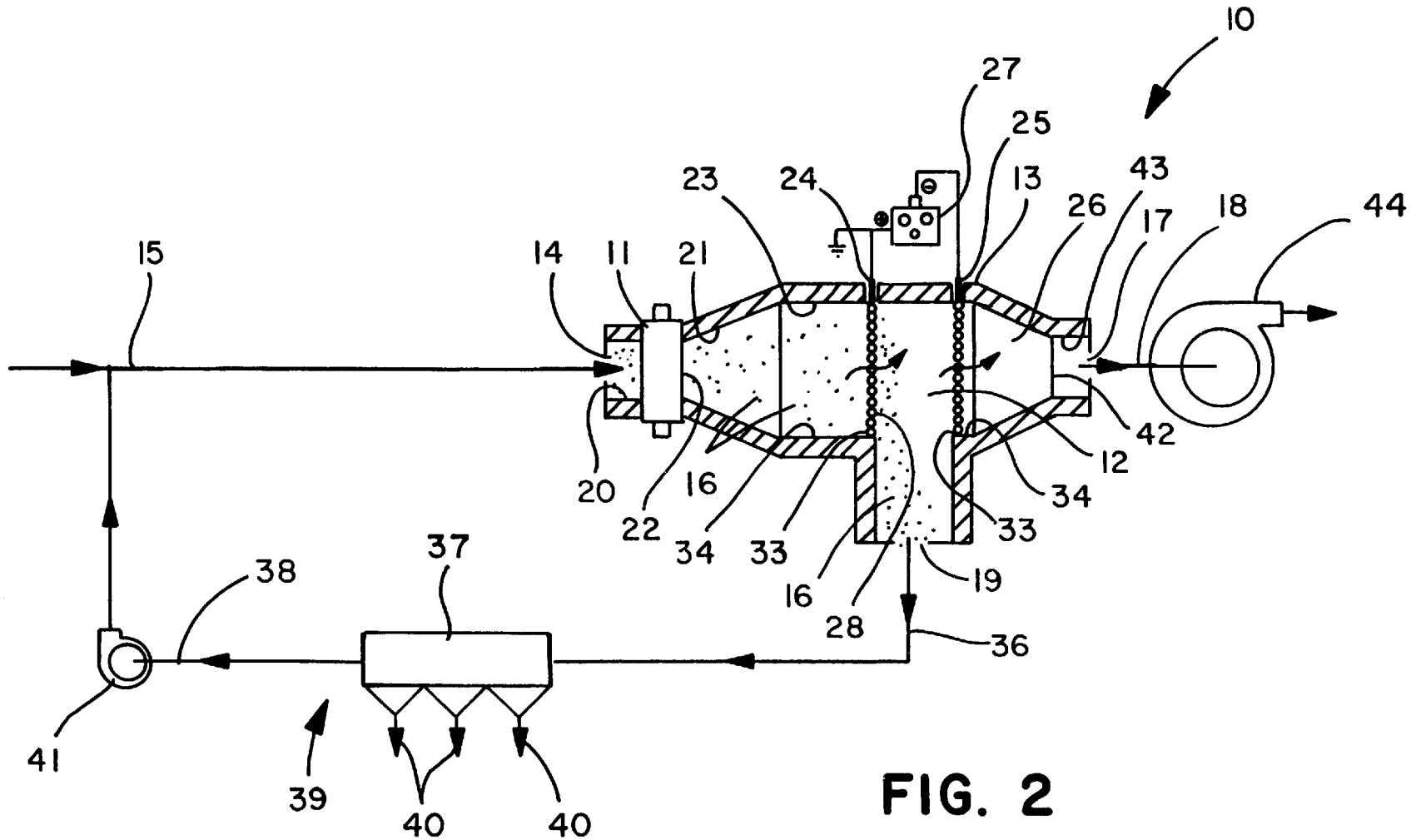
FIG. 2 shows somewhat schematically the flow diagram of the system incorporating the electrostatic separator of FIG. 1 and a collector situated in the recirculation loop of the electrostatic separator.
Figure 3:
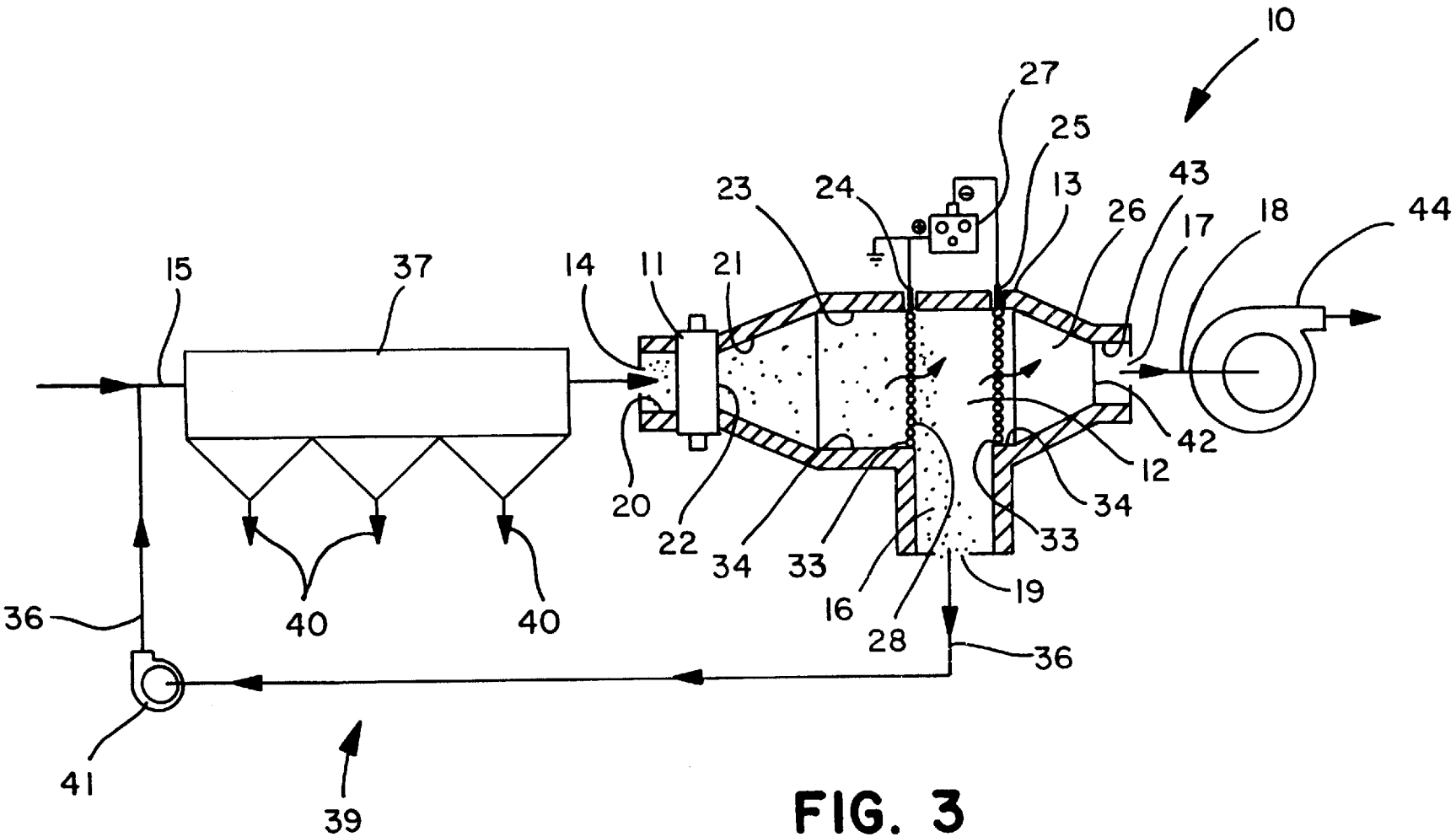
FIG. 3 shows somewhat schematically the flow diagram of the system incorporating the electrostatic separator of FIG. 1 and a collector situated upstream therefrom.

A power source 27 supplies power to the separating section 12 which is located in the middle section 23 of the housing 13 and, as best shown in FIGS. 1–3, and is formed between a grounded electrode 24 (which constitutes a front wall of the separating section 12) and a discharge electrode 25 (which constitutes a rear wall of the separating section 12). Both the grounded electrode 24 and the discharge electrode 25 are made gas-permeable, such that the particle laden gas stream 15 easily penetrates through the grounded electrode 24 into the separating section 12, and such that the clean gas stream 18 easily penetrates through the discharge electrode 25 and flows from the separating section 12 into a cone-shaped exiting section 26 of the housing 13. The cone-shaped exiting section 26 simultaneously converges towards a narrower end 42 thereof, and the clean gas stream 18 further flows towards the clean gas outlet 17, wherefrom it is directed by a fan 44 in a required direction.

It is important that the particles 16 receive a charge in the pre-charging section 11 of the sign opposite to that of the grounded electrode 24 and similar to that of the discharge electrode 25. Then, the pre-charged particles 16 enter the separating section 12 where the electrostatic forces repel them from the discharge electrode 25 towards the grounded electrode 24, while the drag forces act on the particles in the opposite direction. If electrostatic forces acting on the particles are higher than the drag forces, the particles will not be able to penetrate through the discharge electrode 25 into the cone-shaped exiting section 26.

Due to the jet effects, gas velocities in the separating section 12 in the immediate proximity to the grounded electrode 24, and therefore, drag forces in this region, are higher than the average gas velocities and drag forces in the section 12. As a result, some particles, which will not be able to penetrate through the discharge electrode 25, may also be unable to be collected on the grounded electrode 24. These particles will be extracted from the separating section 12 by means of the bleed flow 36. On the other hand, the particles collected on the grounded electrode 24 will be removed form this electrode by means of conventional wall cleaning (rapping, vibrating, acoustic cleaning, etc.), and eventually, will also be removed form the separating section 12 by means of the bleed flow 36. A wall cleaning will be accomplished permanently or periodically, but often enough to prevent the particles from losing their charges on the grounded electrode 24.

As best shown in FIG. 1, edges 33 of the electrodes 24 and 25 closely engage the internal walls 34 of the housing 13 and their internal surfaces coincide with the internal walls 35 of the bleed flow section 32, such that any leakage of untreated particles through clearances which might exist between the edges of the electrodes and the walls of the housing 13 is precluded, and no untreated particles can leak into the clean gas stream 18.

Particles separated from the gases in the separating section 12 and removed therefrom together with some bleed flow 36 and can be directed to a conventional dust collector 37, such as an ESP (electrostatic precipitator), baghouse or mechanical collector. As best shown in FIGS. 2 and 3, clean gases 38 leaving the conventional dust collector 37 can be recirculated back to the inlet 14 of the ES 10. In this design arrangement, the ES IO high separation efficiency actually determines the system collection efficiency. If the ES 10 separation efficiency is very high, particulates cannot leave the system. They will recirculated until they are extracted from the system by the collector 37.

The collector 37 can be situated downstream (FIG. 2) or upstream (FIG. 3) from the ES 10. The collector 37 shown in the system of FIG. 2, will be quite compact because it treats only a small fraction of the process flow. In the system shown in FIG. 3, the collector 37 is a "heavy-duty" dust collector, and the ES 10 performs as a polishing device for the underperforming collector 37.

In operation, particles separated from gases in the separating section 12 together with some bleed flow 36 are directed to the particle collector 37 located in the recirculation flow line 39. Some particles 40 are extracted from the system, and particles not collected during the first cycle are recirculated by means of the fan 41 back to the inlet 14 of the ES 10 inlet. The flow diagram in FIG. 3 is similar in form and function to that in FIG. 2 except that the particle collector 37 is situated upstream from the ES 10.

As discussed above, the ES 10 in FIG. 1 employs the gas-permeable discharge and grounded electrodes, but in contrast to the existing state-of-the-art electrostatic precipitators, its collection efficiency does not depend on the separator ability to form and hold the dust layer on the electrode surfaces. As a result, the collection efficiencies of the ES 10 are very high while a power consumption is low. As had been demonstrated experimentally, the compact ES 10 shown in FIG. 1 and operated with fly ash particles having mass mean particle diameter about 10 $\mu$m can achieve collection efficiencies exceeding 99.99%. It had also been demonstrated that the ES 10 in FIG. 1 is capable of effective operating at high and low solids loadings.

Figure 4:
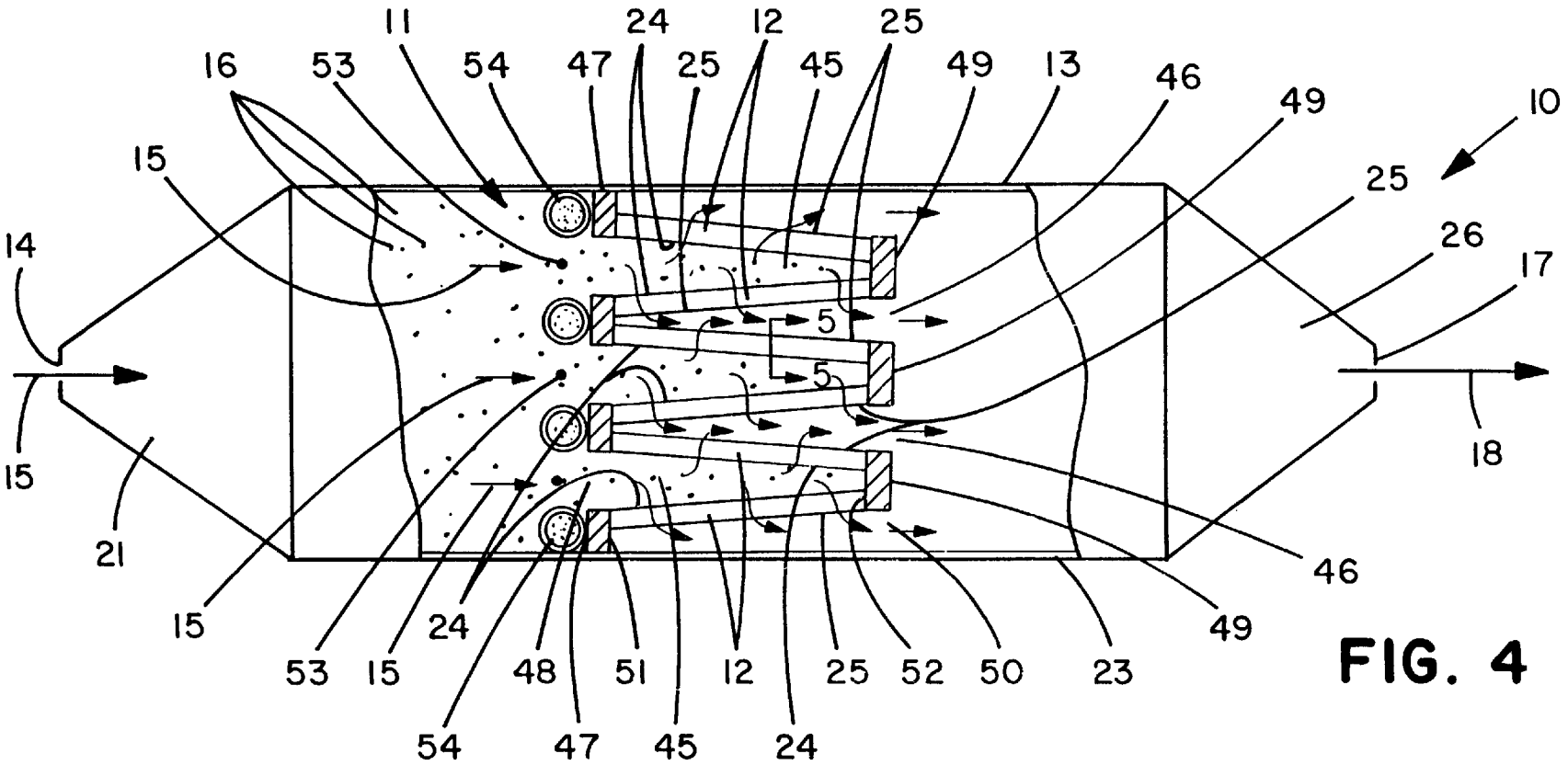
FIG. 4 is a top view of another (and preferred) embodiment of the electrostatic separator of the present invention having a "zig-zag" arrangement of electrodes (a cover of the housing being partially broken-off).
Figure 5:
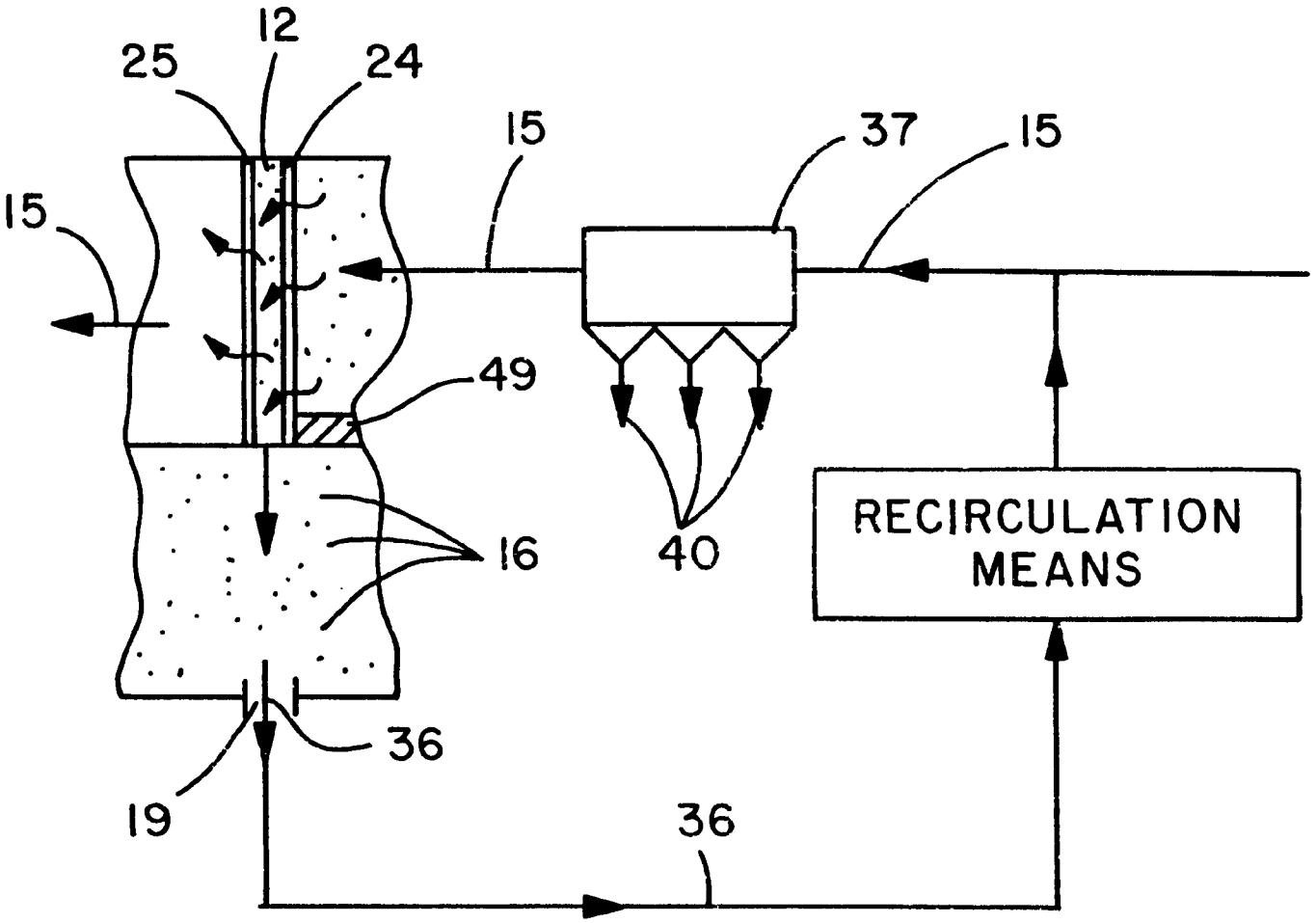
FIG. 5 is a cross-section of the electrostatic separator of FIG. 4 taken along lines 5—5 thereof

An alternative embodiment of the ES 10 of the present invention is shown in FIGS. 4 and 5. The housing 13 incorporates a plurality of the above-discussed pairs of electrodes, each having a grounded electrode 24 and a discharge electrode 25. These pairs are arranged in "zig-zag" (or "accordion") order, as best shown in FIG. 4. The grounded electrodes 24 of adjacent pairs of electrodes form a conduit 45 for receiving the particle laden gas stream 15. The discharge electrodes 25 of adjacent pairs of electrodes form an expelling section 46 for the clean gas stream 18 exiting from the housing 13. A row of aligned front insulator sections 47 is arranged at front edges 48 of the conduits 45. Similarly, a row of aligned rear insulator sections 49 is arranged at rear edges 50 of the expelling sections 46. Each pair of electrodes 24 and 25 has a front end 51 and a rear end 52. As best shown in FIG. 4, respective adjacent pairs of electrodes have their front ends 51 affixed to the same front insulator section 49, while the rear ends 52 of respective adjacent pairs of electrodes 24 and 25 are affixed to the same rear insulator section 50.

The pre-charging section 11 in the ES 10 shown in FIG. 4, includes a plurality of ionizing electrodes 53 (each arranged upstream and between the adjacent front insulator sections 47) and a plurality of water cooled tubes 54 (each arranged in close proximity to each front insulator section 47).

In operation, the particle laded gas stream 15 flows horizontally through the precharging section 11, enters conduits 45, the sides of which are formed by perforated grounded electrodes 24 permeable for gases and particles, penetrates through apertures (or louvers) in these grounded electrodes 24, and enters the separating section 12 (or plenum) between the discharge electrodes 25 and grounded electrodes 24, wherein the particles 16 precharged in the precharging section 11 are separated from the gases. As shown in FIG. 5, the particles 16 are directed downwardly and are extracted from the ES 10 together with some bleed flow 36. Gases cleaned of particles penetrate through apertures in the gas-permeable discharge electrodes 25 and leave the housing 13.

The separation mechanisms discussed above for the embodiment shown in FIGS. 1–3, are similar to those taking place for the embodiment shown in FIGS. 4 and 5. However, the latter embodiment (FIGS. 4, 5) has some advantages over the previous one (FIGS. 1–3) comprising a series of parallel separating sections 12. That allows gas velocities and drag forces acting on the particles to be significantly reduced.

It will be appreciated by those skilled in the art, that the bleed flow 36 of the "zig-zag" type ES 10 can be recirculated similar to the flow diagrams shown in FIGS. 2–3.

Figure 6:
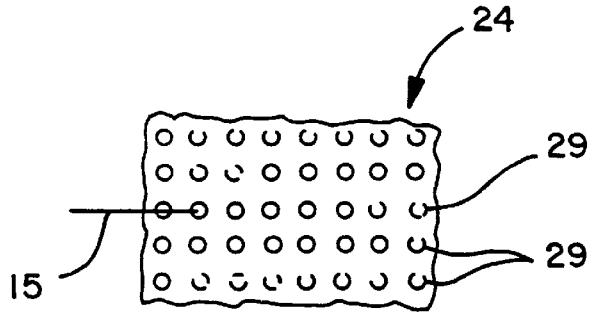
FIG. 6 is a side view showing a collecting (grounded) electrode with a plurality of apertures.
Figure 7:
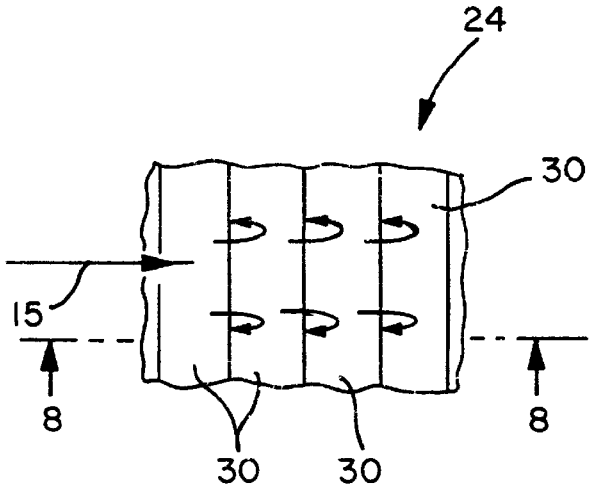
FIG. 7 shows a louver-type collecting (grounded) electrode.
Figure 8:
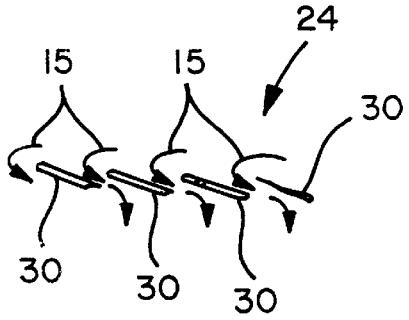
FIG. 8 is a cross-section thereof, taken along the lines 8—8 of FIGS. 7.
Figure 9:
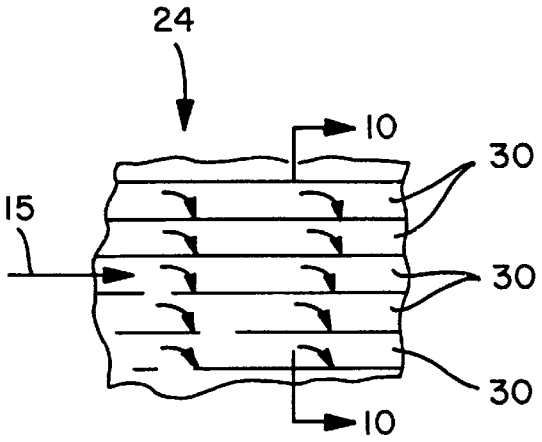
FIG. 9 is a further louver-type collecting (grounded) electrode.
Figure 10:
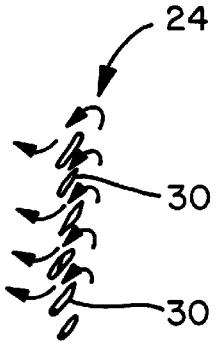
FIG. 10 is a cross-section thereof, taken along the lines 10—10 of FIG. 9.

The grounded "zig-zag" electrodes 24 of ES 10 are perforated (as shown in FIG. 6) or are louver-type electrodes as shown in FIGS. 7–10. The louvers 30 can be positioned either transversely to the particle laden gas stream 15 (as shown in FIGS. 7 and 8) or along thereto, as shown in FIGS. 9 and 10.

Figure 11:
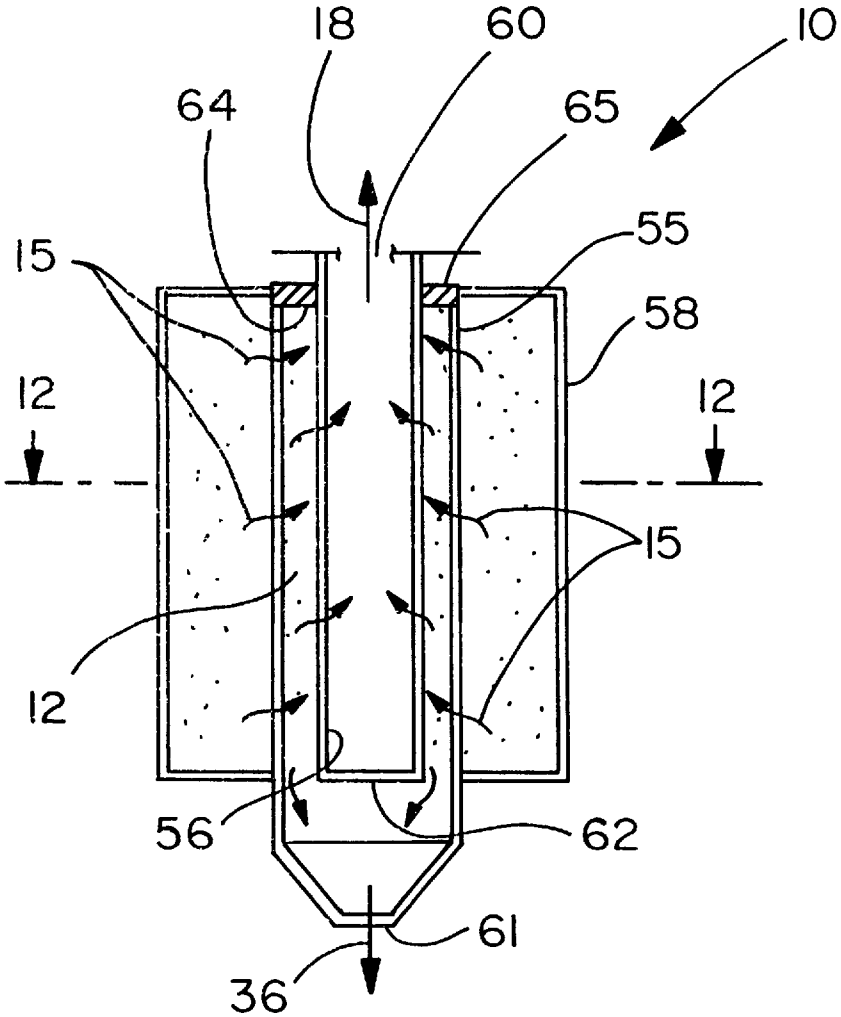
FIG. 11 is a longitudinal cross-section of yet another embodiment of the electrostatic separator of the present invention.
Figure 12:
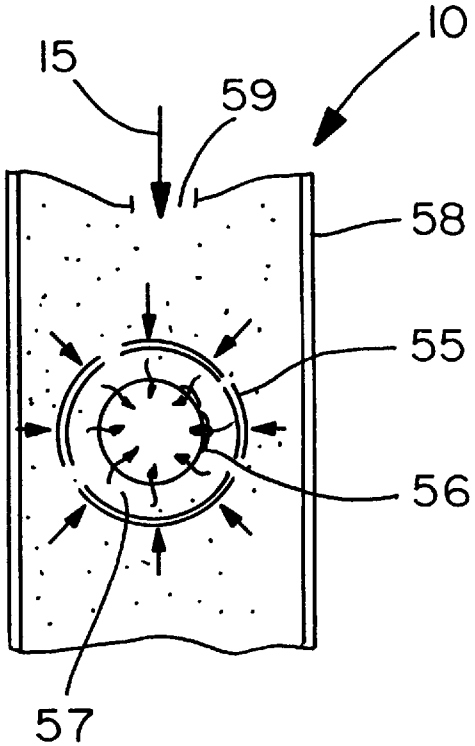
FIG. 12 is a cross-section of FIG. 11 taken along lines 12—12 thereof.
Figure 13:
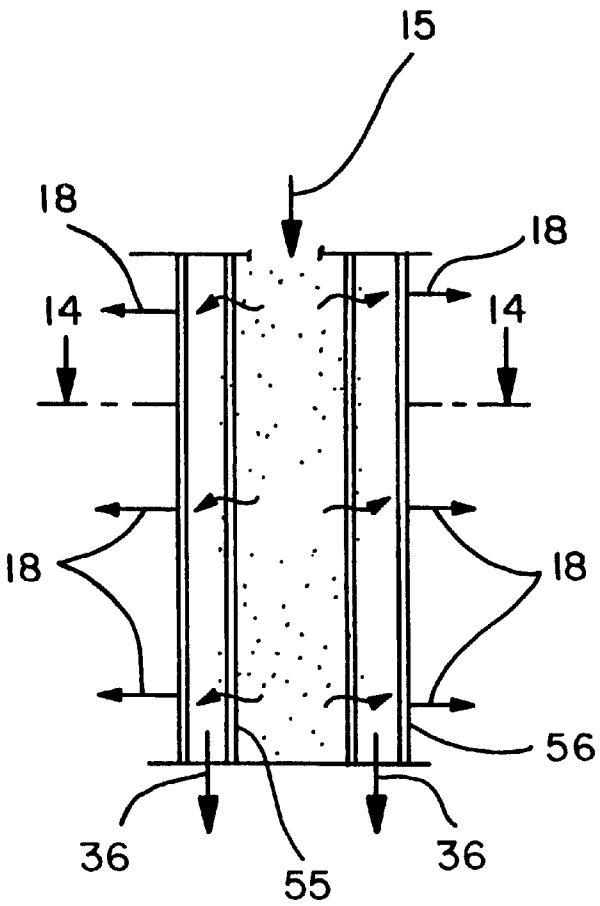
FIG. 13 shows somewhat schematically a modification of the electrostatic separator of FIGS. 11 and 12.
Figure 14:
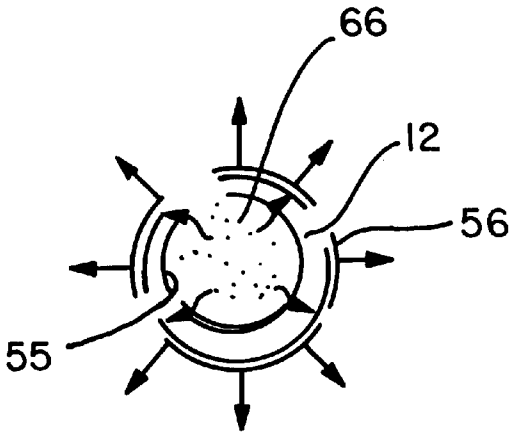
FIG. 14 is a cross-section of FIG. 13, taken along lines 14—14 thereof.

Yet another embodiment of the ES 10 of the present invention is shown in FIGS. 11–14 and includes a pair of co-axial cylindrical electrodes, one of which is a grounded cylindrical electrode 55 and another is a discharge cylindrical electrode 56. As best shown in FIGS. 11 and 12, the cylindrical grounded electrode 55 can be positioned outside from the cylindrical discharge electrode 56; or as best shown in FIGS. 13 and 14, the cylindrical grounded electrode 55 can be positioned inside of the cylindrical discharge electrode 56. For both embodiments of FIGS. 11–14, the cylindrical electrodes 55, 56 are gas-permeable electrodes and the separating section 57, determined therebetween, has an annular shape. The co-axial electrodes 55 and 56 are contained in a housing 58 having an inlet 59 for the particle laden gas stream 15, an outlet 60 for the clean gas stream 18, and an outlet 61 for the bleed flow 36. As best shown in FIGS. 11 and 12, the particle laden gas stream 15 is received in the housing 58 so as to surround the grounded electrode 55 and to penetrate to the separating section 57 through the surface of the grounded electrode 55. The particles 16 are separated from the gas steam in the separating section 57 and are removed from the ES 10 with the bleed flow 36. As best shown in FIG. 11, the internal discharge electrode 56 has a blind bottom 62 so that the particles from the bleed flow 36 cannot enter a clean gas section 63 within the discharge electrode 56; therefore, they are not permitted to enter the clean gas stream 18 exiting through the outlet 60. The separating section 57 is also closed at its top 64 by an electrical insulator 65 shaped as a ring which prevents the electrodes 55 and 56 from being short-circuited, keeps them in proper relative positioning, and impedes the particles from the separating section 57 from escaping to the outside of the ES 10.

As shown in FIGS. 11 and 12, the clean gas outlets 60 and the bleed flow outlet 61 are arranged co-axially, while the inlet 59 is angled with respect to both of them, preferably, at the right angle. Although the relative disposition of the inlet 14 and outlets 17 and 19 of the above-discussed embodiments shown in FIGS. 1–5 is different from those of FIGS. 11–12, the bleed flow 36 from the cylindrical ES 10 can be recirculated similar to recirculation shown for the above-discussed embodiments of FIGS. 1–5.

It will be appreciated by those skilled in the art, that for the cylindrical electrodes arranged as shown in FIGS. 13 and 14, the particle laden gas stream 15 is supplied into a conduit 66 inside of the grounded electrode 55, the clean gas stream 18 exits through the surface of the discharge electrode 56, and the bleed flow 36 is expelled from the separating section 57 substantially perpendicularly to the clean gas stream 18. Accordingly, the inlet and outlets in a housing (not shown) will be positioned in different arrangement compared to those described above; however, the principles of recirculation of the bleed flow 36 are similar to those discussed for the above embodiments and shown in FIGS. 2–3.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A two-stage electrostatic separator for separating particles from a particle laden gas stream, the separator comprising:

a housing;

a plurality of pairs of spaced-apart gas-permeable first and second oppositely charged electrodes in a zig-zag arrangement thereof, the first electrodes being grounded and positioned upstream from the second electrodes;

a separating section defined between the first and second electrodes in each of said plurality of pairs of electrodes; and a pre-charging section in fluid communication with the separating section of each of said plurality of pairs of electrodes and positioned upstream therefrom;

each of said plurality of pairs of electrodes having a first end and a second end;

wherein said first electrodes of adjacent said pairs of electrodes comprise a conduit receiving the particle laden gas stream;

wherein said second electrodes of adjacent said pairs of electrodes comprise a section expelling a clean gas stream;

wherein the housing incorporates said plurality of electrodes and the pre-charging section and further has an inlet, a first outlet co-axial with the inlet, and a second outlet, substantially perpendicular to an axis connecting the inlet and the first outlet;

wherein the housing further includes an entering section, a middle section and an exiting section;

wherein the entering and the exiting sections of the housing respectively extend from the middle section in opposite directions and gradually narrow toward the inlet and the first outlet, respectively;

wherein the particle laden gas stream enters into the separator through the inlet, flows into the entering section of the housing and diverges therein, thereby slowing down the motion thereof, and further slowly flows into the separating sections positioned in the middle section of the housing;

wherein the particles in the particle laden gas stream are pre-charged to a certain charge in the pre-charging section prior to entering the conduit and penetrate through the first electrodes into the separating sections of said plurality of pairs of electrodes, such that the particles are separated from the particle laden gas stream therein;

wherein a clean gas stream exits from the separating sections through the second electrodes;

wherein the clean gas stream flows from the expelling sections toward a narrower end of the exiting section of the housing and exits the separator through the first outlet;

wherein the particles separated from the particle laden gas stream are removed from each separating section with a bleed flow arranged through the second outlet;

wherein a recirculation means directs the bleed flow from the second outlet toward the inlet of the separator and collects the particles carried by the bleed flow prior to entering the separator;

the separator further including a row of front insulator sections and a row of rear insulator sections, wherein the first ends of respective adjacent said pairs of electrodes are affixed to a respective one of said row of front insulator sections, wherein the second ends of respective adjacent said pairs of electrodes are affixed to a respective one of said row of rear insulator sections;

wherein the pre-charging section includes a plurality of ionizing electrodes each arranged upstream from and between the adjacent said front insulator sections, and a plurality of water-cooled tubes, each adjacent to a respective one of said front insulator sections;

wherein the particle laden gas stream enters a plurality of said conduits through front edges thereof between adjacent of said plurality of front insulator sections; and wherein the clean gas stream exits a plurality of said expelling sections through rear edges thereof between adjacent of said plurality of rear insulator sections.

2. A two-stage electrostatic separator for separating particles from a particle laden gas stream, the separator comprising:

a pre-charging section and a separating section in fluid communication with the pre-charging section and positioned downstream therefrom;

a pair of spaced-apart gas-permeable co-axial cylindrical electrodes charged at opposite polarities and with said separating section of an annular shape defined therebetween, with a first one of said pair of cylindrical electrodes being grounded and positioned upstream from a second one of said pair of cylindrical electrodes;

a housing incorporating said pre-charging section and said pair of electrodes and having co-axial first and second outlets and an inlet substantially perpendicular to an axis of the first and the second outlets, wherein the particle laden gas stream enters into the separator through the inlet, wherein the particles in the particle laden gas stream are pre-charged to a certain charge in the pre-charging section and penetrate through the first cylindrical electrode into the annular separating section, wherein the particles are separated from the particle laden gas stream, such that a clean gas stream exits from the separating section through the second cylindrical electrode and further exits the separator through the first outlet, and the particles separated from the particle laden gas stream are removed from the separating section with a bleed flow arranged from the annular separating section through the second outlet.

3. A two-stage electrostatic separator for separating particles from a particle laden gas stream, the separator comprising:

a housing;

a pre-charging section and a separating section in fluid communication with the pre-charging section and positioned downstream therefrom;

at least a pair of spaced-apart gas-permeable electrodes charged at opposite polarities and with said separating section therebetween, with a first one of said pair of electrodes being grounded and positioned upstream from a second one of said pair of electrodes;

wherein the particles in the particle laden gas stream are pre-charged to a certain charge in the pre-charging section and penetrate through the first electrode into the separating section, wherein the particles are separated from the particle laden gas stream, such that a clean gas stream exits from the separating section through the second electrode, and such that the particles separated from the particle laden gas stream are partially collected on the grounded electrode and wherein said two-stage electrostatic separator has a plurality of said pairs of spaced-apart gas-permeable electrodes in a zig-zag arrangement thereof, each of said pairs having a first end and a second end, wherein said first electrodes of adjacent said pairs of electrodes comprise a conduit receiving the particle laden gas stream; wherein said second electrodes of adjacent said pairs of electrodes comprise a section expelling a clean gas stream, and wherein the particles separated from the particle laden gas stream are partially removed from the separation section of each of said plurality of said pairs of electrodes with a bleed flow arranged in a plane substantially perpendicular to said incoming particle laden gas stream and said outgoing clean gas stream.

4. The separator of claim 3, further including a row of front insulator sections and a row of rear insulator sections, wherein the first ends of respective adjacent said pairs of electrodes are affixed to a respective one of said row of front insulator sections, wherein the second ends of respective adjacent said pairs of electrodes are affixed to a respective one of said row of rear insulator sections, wherein the pre-charging section includes a plurality of ionizing electrodes each arranged upstream from and between the adjacent said front insulator sections, and a plurality of water-cooled tubes, each adjacent to a respective one of said front insulator sections.

5. The separator of claim 4, wherein the particle laden gas stream enters a plurality of said conduits through front edges thereof between adjacent of said plurality of front insulator sections, and wherein the clean gas stream exits a plurality of said expelling sections through rear edges thereof between adjacent of said plurality of rear insulator sections.

6. The separator of claim 3, further including an inlet for incoming particle laden gas stream, a first outlet for outgoing clean gas stream and said bleed flow providing an outlet for outgoing particle laden gas from each of said pairs of electrodes, and further including a recirculation means directing said bleed flow toward the particle laden gas stream entering the separator.

7. The separator of claim 6, further including a particle collecting means positioned between the second outlet and the inlet, such that prior to being supplied to the inlet, the bleed flow passes through said particle collecting means.

8. The separator of claim 6, further including a particle collecting means positioned upstream from the inlet of the separator, so that, prior to entering the separator, both the particle laden gas stream and the bleed flow pass through said particle collecting means.

9. The separator of claim 3, wherein the pre-charging section is positioned within the housing.

10. A two-stage electrostatic separator for separating particles from a particle laden gas stream, the separator comprising:

a pre-charging section and a separating section in fluid communication with the pre-charging section and positioned downstream therefrom;

at least a pair of spaced-apart gas-permeable electrodes charged at opposite polarities and with said separating section therebetween, with a first one of said pair of electrodes being grounded and positioned upstream from a second one of said pair of electrodes and wherein said first electrode includes a plurality of louvers;

wherein the particles in the particle laden gas stream are pre-charged to a certain charge in the pre-charging section and penetrate through the first electrode into the separating section, wherein the particles are separated from the particle laden gas stream, such that a clean gas stream exits from the separating section through the second electrode, and such that the particles separated from the particle laden gas stream are partially collected on the grounded electrode.

11. A two-stage electrostatic separator for separating particles from a particle laden gas stream, the separator comprising:

a pre-charging section and a separating section in fluid communication with the pre-charging section and positioned downstream therefrom;

at least a pair of spaced-apart gas-permeable electrodes charged at opposite polarities and with said separating section therebetween, with a first one of said pair of electrodes being grounded and positioned upstream from a second one of said pair of electrodes and wherein at least one pair of electrodes is a pair of co-axial outer and inner cylindrical electrodes defining the annular separating section therebetween;

wherein the particles in the particle laden gas stream are pre-charged to a certain charge in the pre-charging section and penetrate through the first electrode into the separating section, wherein the particles are separated from the particle laden gas stream, such that a clean gas stream exits from the separating section through the second electrode, and such that the particles separated from the particle laden gas stream are partially collected on the grounded electrode.

12. The separator of claim 11, wherein the outer electrode is grounded, wherein the particle laden gas stream flows into the annular separating section through the outer electrode substantially tangentially thereto, wherein the clean gas stream exits from the annular separating section through the inner electrode and escapes from the separator substantially along the axis of the inner cylindrical electrode, and wherein a bleed flow exits from the annular separating section substantially parallel to the clean gas stream and in the opposite direction.

13. The separator of claim 11, wherein the inner electrode is grounded, wherein the particle laden gas flows into the annular separating section through the inner electrode substantially tangentially thereto, wherein the clean gas stream exits from the annular separating section through the outer electrode substantially tangentially thereto, and wherein a bleed flow exits from the annular separating section substantially perpendicular to the particle laden gas stream and to the clean gas steam.

* * * * *